US009826831B1

(12) United States Patent
Farmer

(10) Patent No.: US 9,826,831 B1
(45) Date of Patent: Nov. 28, 2017

(54) RUGGEDIZED PORTABLE STORAGE AND TRANSPORT UNIT

(71) Applicant: Matt Farmer, Calhan, CO (US)

(72) Inventor: Matt Farmer, Calhan, CO (US)

(73) Assignee: CAVE MAGNA CANEM, LLC, Calhan, CO (US)

( * ) Notice: Subject to any disclaimer, the term of this patent is extended or adjusted under 35 U.S.C. 154(b) by 0 days.

(21) Appl. No.: 15/406,676

(22) Filed: Jan. 14, 2017

(51) Int. Cl.

| | |
|---|---|
| ***A47B 83/04*** | (2006.01) |
| ***A47B 5/04*** | (2006.01) |
| ***A47B 57/06*** | (2006.01) |
| ***E04H 1/12*** | (2006.01) |
| ***E06B 3/38*** | (2006.01) |

(52) U.S. Cl.
CPC ..... *A47B 83/045* (2013.01); *A47B 5/04* (2013.01); *A47B 57/06* (2013.01); *E04H 1/1205* (2013.01); *E06B 3/385* (2013.01)

(58) Field of Classification Search
None
See application file for complete search history.

(56) References Cited

U.S. PATENT DOCUMENTS 3,984,162 A * 10/1976 Zozzaro ..... A47B 31/00 312/100
4,706,817 A * 11/1987 Greathouse ..... A47B 31/02 126/25 R
5,102,209 A * 4/1992 Hesseltine ..... A47B 81/00 312/244
6,752,477 B2 * 6/2004 Goldberg ..... A47B 21/00 312/223.6
8,256,622 B2 * 9/2012 Ahlberg ..... A47F 5/10 206/216
8,696,075 B1 * 4/2014 Rios ..... A47F 10/06 126/25 R
2002/0096509 A1 * 7/2002 Von Mosshaim ... A47J 36/2483 219/452.11
2002/0130598 A1 * 9/2002 Schmidt ..... A47B 46/00 312/324
2007/0029746 A1 * 2/2007 Brennan ..... B25H 3/00 280/47.26
2008/0000171 A1 * 1/2008 McKay ..... A47B 31/00 52/36.1

* cited by examiner

*Primary Examiner* — Hau V Phan

(74) *Attorney, Agent, or Firm* — Avery Enterprises, Inc.; Bryce D. Avery

(57) ABSTRACT

Disclosed is a portable storage and transport unit that can be easily moved, even through rough terrain, to any desired location. The unit includes a continuous supported work surface area around its entire perimeter, as well as multiple methods of adjusting the unit's center of gravity to reduce the effort needed to move it. The unit includes an optional weather shelter, the ability to be towed by a vehicle even when fully loaded, and a separate gear rack to accommodate efficient wheeled transport of even more gear.

13 Claims, 14 Drawing Sheets

Figure 5
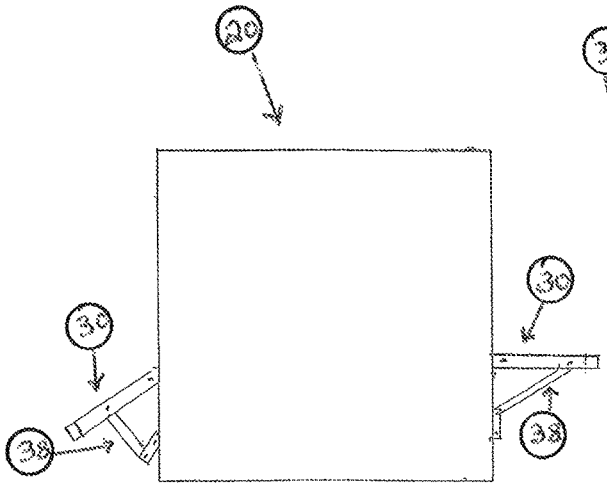
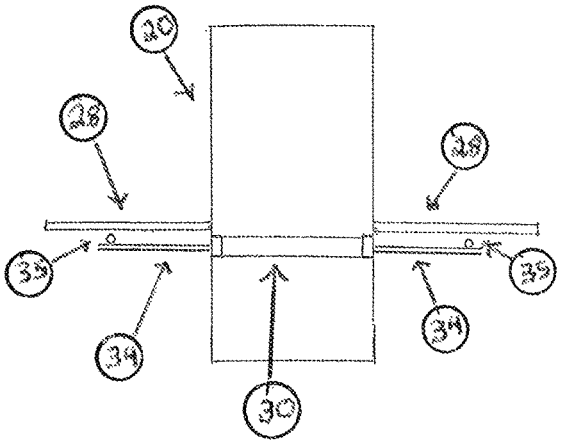
Figure 6
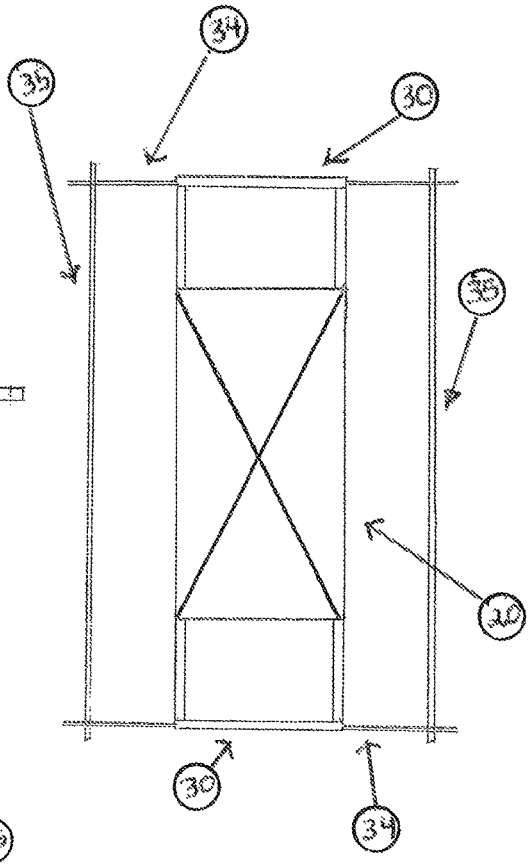
Figure 7

RUGGEDIZED PORTABLE STORAGE AND TRANSPORT UNIT

BACKGROUND OF THE INVENTION a. Field of the Invention

The present invention generally pertains to portable outdoor gear transport and storage units and more particularly to portable outdoor gear transport and storage units that hold gear commonly used in outdoor experiences and in other places and situations where comprehensive and efficient transport and storage of gear may be useful.

b. Description of the Background

Boy Scout leaders, remote caterers, hunting guides and any others whose work or play involves remote outdoor gear transport often find it endlessly tedious and difficult to find, pack, transport, use, repack and restore their needed gear efficiently. Without a simple compact system for packing, transporting, using and storing such gear, hundreds of items of gear may require packing or repacking after every single event.

Peterson et. al. (U.S. Pat. No. 5,683,157) discloses a portable kitchen with no cooking capability. The unit folds compactly into a box. However, to position the work surface at a convenient height, it must be placed on a table or elevated in some other way. No way is provided to prevent items in the kitchen from precipitation.

Myers (U.S. Pat. No. 4,089,554) presents a foldable kitchen unit that includes storage compartments. However, FIG. 1 in Myers shows the only support for the unit is the bumper of a truck; thus, people not using a truck on a given outing find the unit much less usable, especially since no support legs are provided.

It would therefore be advantageous to have a portable outdoor transport and storage unit that can be easily moved, even through rough terrain, to any desired location. It would also be advantageous if such a unit included a continuous supported work surface area around its entire perimeter, as well as multiple methods of adjusting the unit's center of gravity to reduce the effort needed to move it. It would further be advantageous if the unit had an optional weather covering to protect its contents from precipitation and the ability to be used without being physically supported by a truck. It would be even more advantageous if the unit also included a separate gear rack to accommodate efficient wheeled transport of even more gear.

SUMMARY OF THE INVENTION

The present invention overcomes the disadvantages and limitations of the prior art by providing a portable storage and transport unit that can be easily moved, even through rough terrain, to any desired location. The unit includes a continuous supported work surface area around its entire perimeter, as well as multiple methods of adjusting the unit's center of gravity to reduce the effort needed to move it. The unit includes an optional weather shelter, the ability to be towed by a vehicle even when fully loaded, and a separate gear rack to accommodate efficient wheeled transport of even more gear.

The present invention may therefore comprise: a portable storage and transport unit, comprising: at least one upper storage area, designed at a height to allow efficient storage of less heavy objects, whose hinged door opens downward and lies flat and serves as part of a continuous supported work surface area around the entire perimeter of the portable storage and transport unit; at least one lower storage area that can accommodate very heavy objects that cannot be safely placed in the upper storage area and whose hinged door opens downward and lies flat; a top storage area, covered by a lid; a set of removable support legs that can raise the storage and transport unit off the ground and support the portable storage and transport unit in a stationary position; a set of gear rack guide tubes that keeps the bottom of the portable storage and transport unit off the ground; a hinged handle that may be locked in a fully horizontal position and allows the portable storage and transport unit to be lifted and carried; a mechanism for adjusting the center of gravity of the portable storage and transport unit to allow easier transport of more gear; a set of side rollers secured to the portable storage and transport unit; and a set of top rollers secured to the portable storage and transport unit. The upper storage area may contain at least one support point for at least one shelf of adjustable height that may divide the internal space of the upper storage area into smaller storage spaces.

The present invention may further comprise: a system that shelters the portable storage and transport unit from weather, comprising: a weather shelter frame; a cover for the weather shelter frame, made of a water-resistant material; a set of weather shelter support poles that connects to and supports the weather shelter frame, is adjustable to a desired height, can be installed at a desired distance from the portable storage and transport unit, and may be secured into the ground to permit a cover for the weather shelter frame to be placed over the weather shelter frame; a set of wind anchors, installed at ground level for each of the set of weather shelter support poles; and, a set of sliding gear rack weather shelter beams that fits into the set of gear rack guide tubes and is longer horizontally than the portable storage and transport unit. The weather shelter frame may include at least one side panel.

The present invention may further comprise: the portable storage and transport unit, wherein the continuous supported work surface area around the entire perimeter of the portable storage and transport unit is created by a combination of the hinged door of the upper storage area, at least one piece of removable lateral work surface support material that slides through and is centered in the hinged handle, at least one piece of removable longitudinal work surface support material, and at least one piece of removable foldable U-shaped hinged work surface material that is set structurally upon the hinged handle.

One mechanism for adjusting the center of gravity of the portable storage and transport unit may comprise: a set of gear rack guide tubes; a set of sliding gear rack weather shelter beams, with holes drilled along the length of the set of sliding gear rack weather shelter beams to accommodate fasteners, that fits into the set of gear rack guide tubes; a gear rack beams handle that connects to and forms a U-shaped unibody structure with the sliding gear rack weather shelter beams; and, an axle that, when adjusted, adjusts the center of gravity of the portable storage and transport unit by moving the set of sliding gear rack weather shelter beams along the length of the set of gear rack guide tubes and allowing the set of sliding gear rack weather shelter beams to be fastened into the set of gear rack guide tubes at a desired location.

Another mechanism for adjusting the center of gravity of the portable storage and transport unit may comprise: an adjustable axle screw jack held in place by screw jack spin blocks at each end; an axle movable along the length of the adjustable axle screw jack; a set of ruggedized wheels connected to the axle; and, a removable crank handle that, when cranked, moves the axle and the set of ruggedized wheels along the length of the adjustable axle screw jack.

The present invention may further comprise: a U-shaped gear rack whose storage areas include a top gear bay and two side gear bays and that rolls on or off the top of the portable storage and transport unit by use of the side rollers and top rollers. A mechanism may allow towing of the portable storage and transport unit by a vehicle smaller than a truck or SUV. That mechanism may have an adjustable center of gravity that may be adjusted by a mechanism comprising: an adjustable axle screw jack held in place by screw jack spin blocks at each end; an axle movable along the length of the adjustable axle screw jack; a set of ruggedized wheels connected to the axle; and, a removable crank handle that, when cranked, moves the axle and the set of ruggedized wheels along the length of the adjustable axle screw jack.

The advantages of the present invention are: a portable storage and transport unit that can be easily moved, even through rough terrain, to any desired location; a continuous supported work surface area around its entire perimeter; multiple methods of adjusting the unit's center of gravity to reduce the effort needed to move it; an optional weather shelter; the ability to be towed by a vehicle even when fully loaded; and a separate gear rack to accommodate efficient wheeled transport of even more gear.

BRIEF DESCRIPTION OF THE DRAWINGS

In the drawings,

FIG. 5 illustrates one embodiment of a side view of the portable storage unit, that shows a hinged handle at each end of the portable storage unit that is part of the present invention.

FIG. 6 illustrates a side view of one embodiment of the structural support system for a continuous supported work surface area that may be created around the entire perimeter of the portable storage unit that is part of the present invention.

FIG. 7 illustrates an overhead view of the embodiment of the continuous supported work surface area shown in FIG. 6.

DETAILED DESCRIPTION OF THE INVENTION

Figure 1:
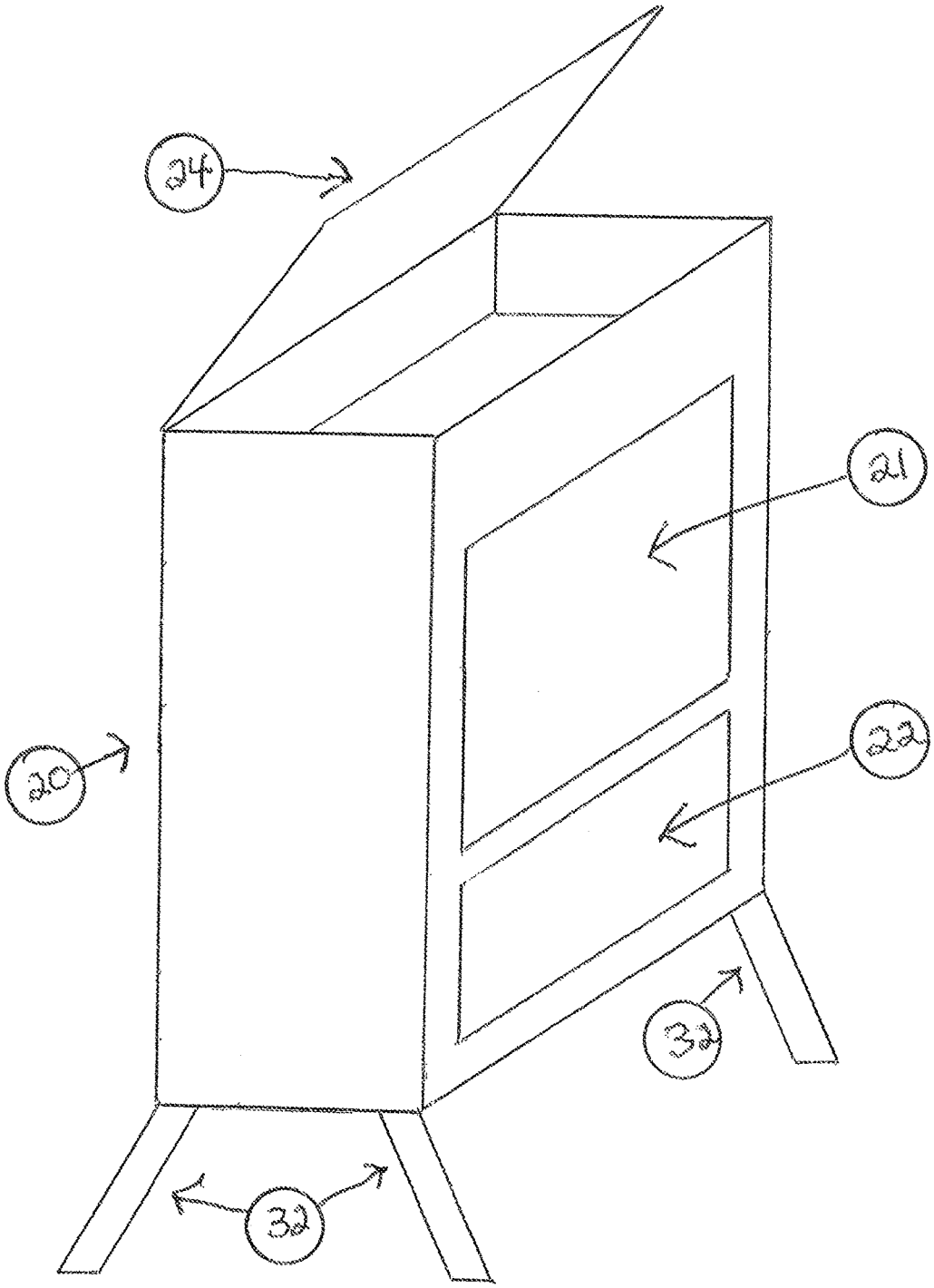
FIG. 1 shows a stationary embodiment of the portable storage unit that is part of the present invention.

FIG. 1 illustrates a stationary embodiment of a portable storage unit 20 that is part of the present invention. The portable storage unit 20 may contain at least one upper storage area 21 that has an openable door and is designed at a height that allows efficient storage of less heavy objects. Such objects may be placed within large lightweight storage tubs for easy transport within the upper storage area 21. In some embodiments of the present invention, each upper storage area 21 may contain at least one support point (not shown in FIG. 1) for at least one shelf of adjustable height that may divide the internal space of the upper storage area 21 into multiple smaller storage spaces as desired.

At least one lower storage area 22 may be designed to store and accommodate very heavy objects that could not be placed in the upper storage area 21 without threatening to tip over the entire present invention. These very heavy objects may include both objects that must be taken from the storage unit to be used (such as a Dutch oven or a bag of charcoal) and objects that can be used from the storage unit without being moved (such as a large water jug or a propane tank that is properly connected to allow such use), A top storage lid 24 may serve as the top of the portable storage unit 20 and may, when in place, also cover another internal storage location which may be used to accommodate a set of removable support legs 32 that raise and support the portable storage unit 20 in its stationary configuration. The internal storage location may also contain metal stakes and wind anchors for an optional weather shelter system that will be detailed later.

Figure 2:
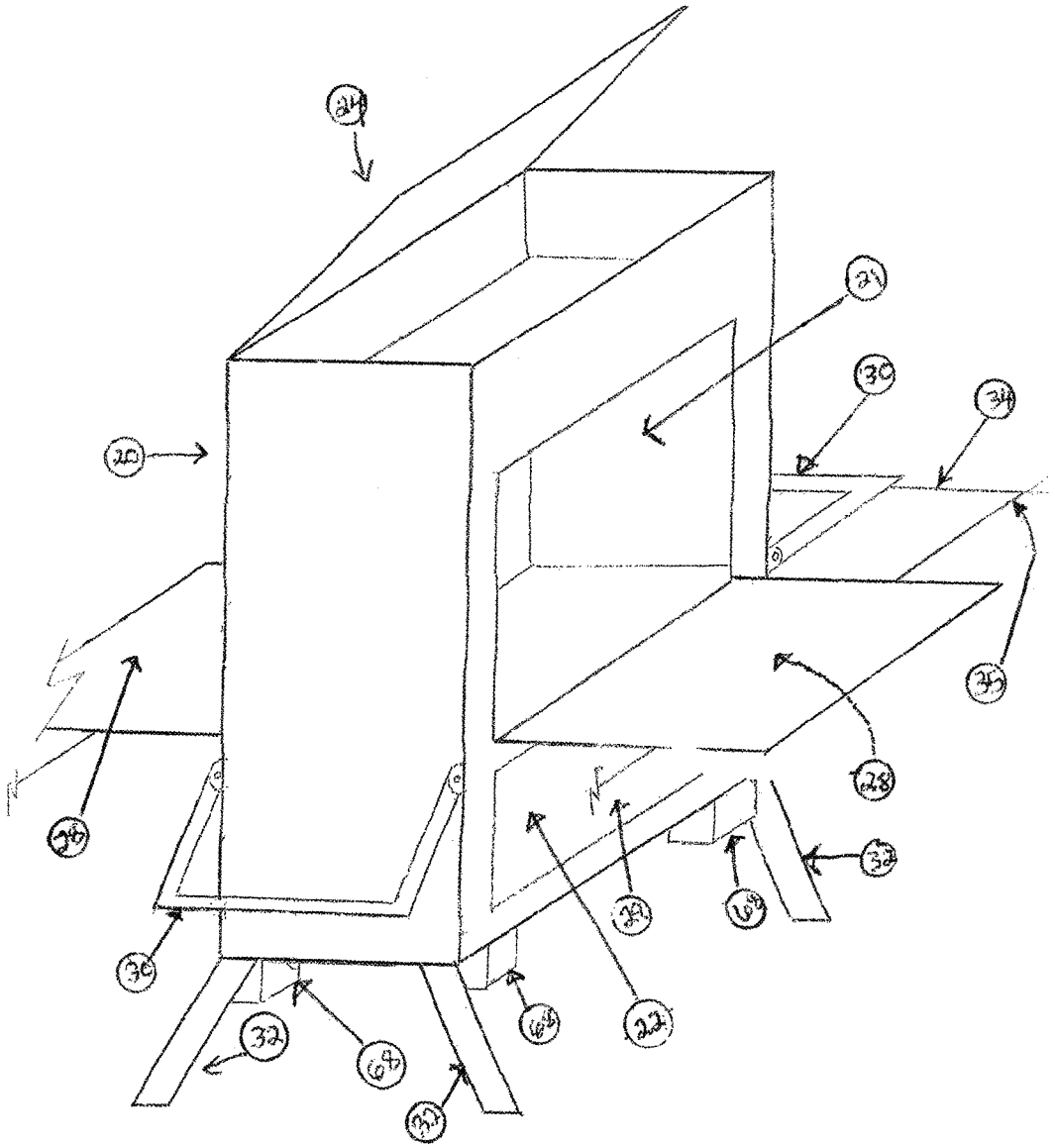
FIG. 2 shows a second stationary embodiment of the portable storage unit that is part of the present invention.

FIG. 2 illustrates a second stationary embodiment of the portable storage unit 20 that is part of the present invention. In this embodiment, the removable support legs 32 may lift the portable storage unit 20 off the ground, support the weight of the portable storage unit 20, keep the portable storage unit 20 stationary, and allow for stability in the footprint of the portable storage unit 20 when site setup must occur on uneven ground. The upper storage area 21 may have at least one hinged door 28 that opens downward to allow material to be placed inside the upper storage area 21. The hinged door 28, when fully opened and laid flat, may also conveniently serve as a workspace while using the materials stored within the portable storage unit 20, such as during meal preparation and food disbursement. The lower storage area 22 may also have at least one hinged door 29 that opens downward to allow material to be placed inside the lower storage area 22. A hinged handle 30 may be placed at each end of the portable storage unit 20 to allow the portable storage unit 20 to be lifted and carried as desired. At least one piece of removable lateral work surface support material 34 may be slid through and centered in the tubing of each hinged handle 30 in a manner that allows each removable lateral work surface support material 34 to perpendicularly connect with and hold at least one piece of removable longitudinal work surface support material 35.

A set of gear rack guide tubes 68 may serve to keep the bottom of the portable storage unit 20 off the ground and out of mud. In embodiments discussed later that have wheels attached to the bottom of the portable storage unit 20, these tubes may accept a set of sliding gear rack weather shelter beams that may be longer than the length of the portable storage unit 20.

Figures 3, 4:
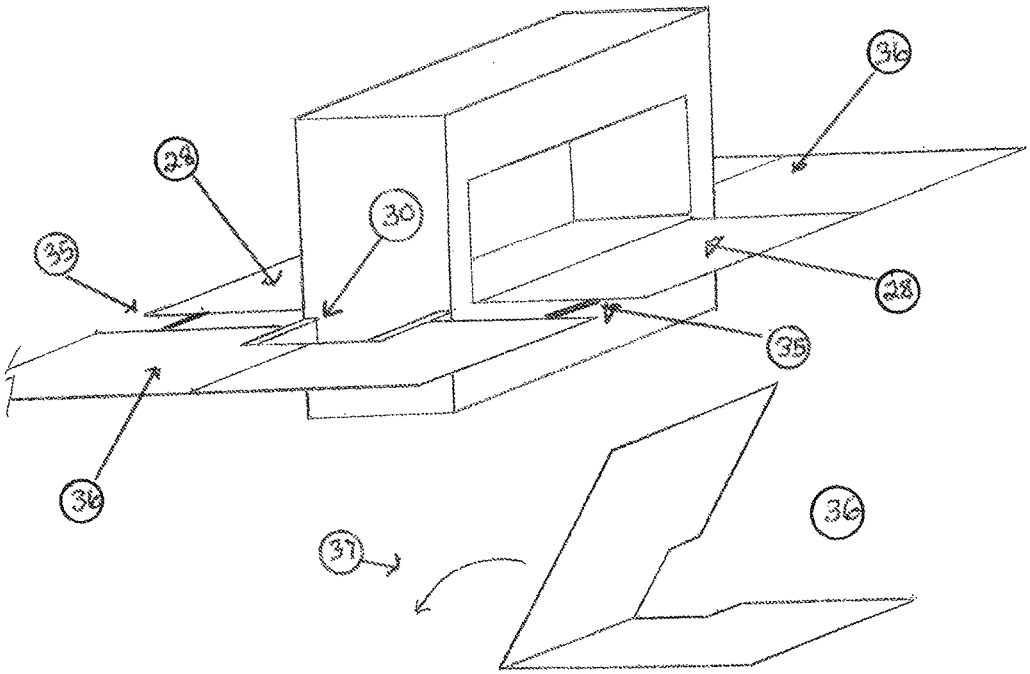
FIG. 3 illustrates one embodiment of how a continuous supported work surface area may be created around the full perimeter of the portable storage unit that is part of the present invention.
FIG. 4 illustrates one embodiment of a removable hinged/end panel work surface, used in combination with hinged doors, to create a continuous supported work surface area around the full perimeter of the portable storage unit that is part of the present invention.

FIG. 3 shows one embodiment of how a continuous supported work surface area may be created around the full perimeter of the portable storage unit 20 that is part of the present invention. The hinged handle 30 may be constructed so that it may be raised to and locked in a fully horizontal position. When the hinged handle 30 is fully horizontal and supported in that position by secure pins, the hinged handle 30 may serve as a base structural layer to support extra work surface material. At least one piece of removable lateral work surface support material 34 (not shown in FIG. 3) may then be slid through and centered in the tubing of each hinged handle 30 in a manner that allows each removable lateral work surface support material 34 to perpendicularly connect with and hold at least one piece of removable longitudinal work surface support material 35, thus creating a full perimeter of support for a continuous work surface area. In some embodiments, the hinged doors 28, support materials 34 and 35 and a removable hinged/end panel work surface 36 may combine to provide a continuous work surface area. Greater details of how these layers of structural materials may fit together are deferred until the description of FIGS. 6 and 7.

FIG. 4 illustrates one embodiment of the removable hinged/end panel work surface 36, used in combination with the hinged doors 28, to create a continuous supported work surface area around the full perimeter of the portable storage unit that is part of the present invention. In this embodiment, the removable hinged/end panel work surface 36 may be foldable and unfoldable in the directions shown by the arrow 37 and designed with a U-shape on one side to set structurally upon the hinged handle 30 while touching both the end wall of the portable storage unit 20 and the adjacent edge of the hinged doors 28. The net effect is creation of a fully supported continuous workspace around the entire perimeter of the portable storage unit 20. A piece of removable hinged/end panel work surface 36 is shown in FIG. 3 as being slid away from a tight fit to the end wall panel and the hinged doors 28 to illustrate how the hinged handle 30 acts as a structural base.

All three elements that may provide structural support for the embodiment in FIG. 3 (the hinged handle 30, removable lateral work surface support material 34 and removable longitudinal work surface support material 35) may be made of appropriate sturdiness to support the weight of all continuous work surface areas shown in FIGS. 2 and 3 without the need for support ropes or chains to keep the doors flat that have often been used in prior art.

FIG. 5 illustrates one embodiment of a side view of the portable storage unit 20 that is part of the present invention and shows the hinged handle 30 at each end of the portable storage unit 20. In this embodiment, each hinged handle 30 is supported by a hinge 38 that may either be fully opened to keep the hinged handle 30 fully horizontal, stationary and usable or may be fully closed and flattened against the side of the portable storage unit 20 as desired.

FIG. 6 illustrates a side view of one embodiment of the structural support system for a continuous supported work surface area that may be created around the entire perimeter of the portable storage unit 20 that is part of the present invention. The hinged door 28 of the upper storage area may be folded down and rested upon or attached to the removable longitudinal work surface support material 35. The structural material that keeps the hinged door 28 horizontal may rest upon the removable lateral work surface support material 34. The removable lateral work surface support material 34 is long enough to be slid through and centered upon the hinged handle 30. The removable lateral work surface support material 34 may then either rest upon or be attached to the hinged handle 30 and the removable longitudinal work surface support material 35 in a manner that results in a continuous workspace area around the perimeter of the portable storage unit 20.

FIG. 7 shows an overhead view of the embodiment of the continuous supported work surface area shown in FIG. 6 of the portable storage unit 20. The hinged handles 30 may be combined with the removable lateral work surface support material 34 and removable longitudinal work surface support material 35 to create the substructure needed to support the continuous workspace area.

Figure 8:
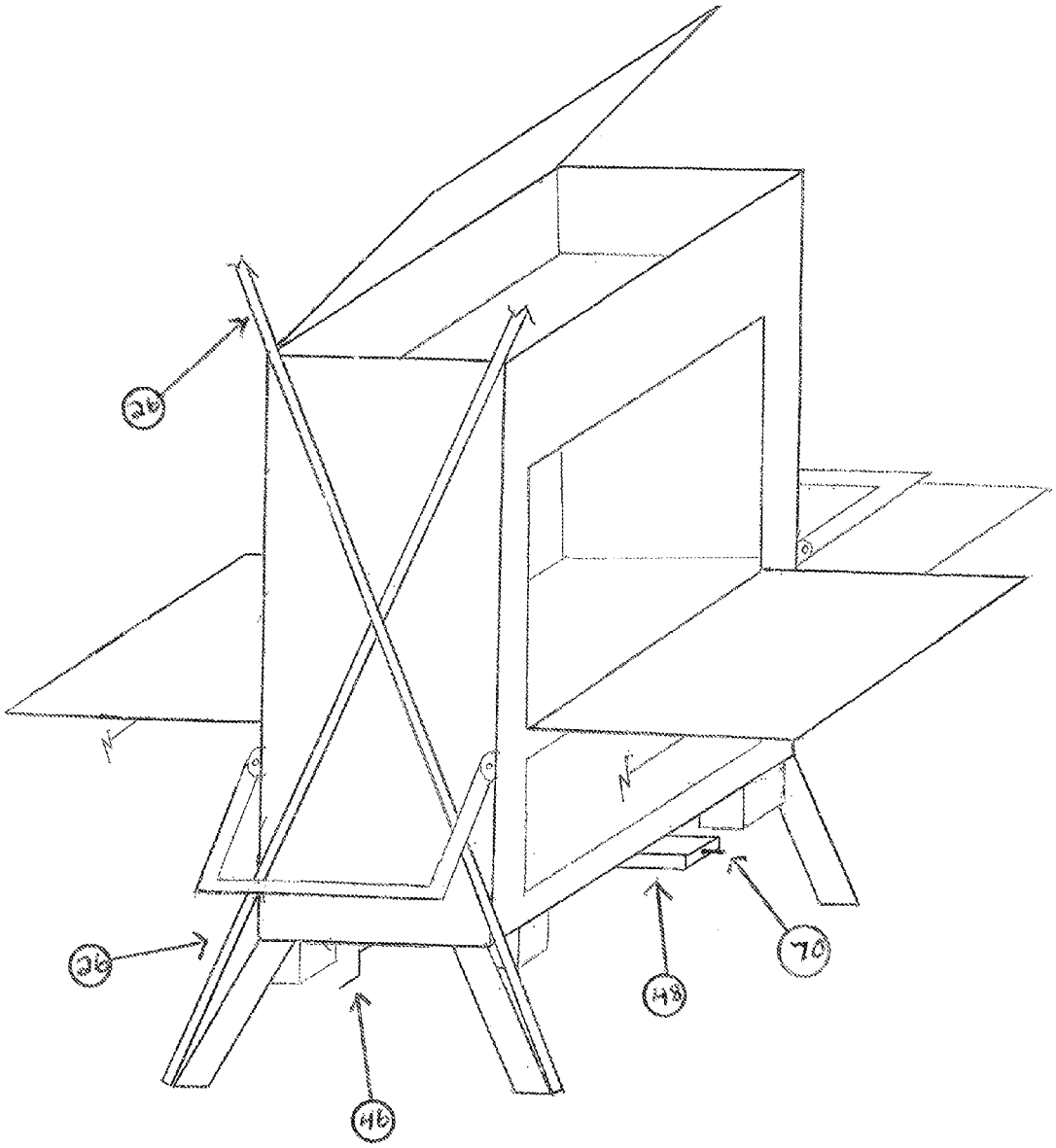
FIG. 8 shows one embodiment of the portable storage unit that is part of the present invention and includes weather shelter support poles, a removable crank handle and an axle that may adjust the loaded center of gravity of the portable storage unit that is part of the present invention. A wind anchor is installed at ground level for each weather shelter support pole.

FIG. 8 shows one embodiment of the portable storage unit 20 that is part of the present invention and includes a set of weather shelter support poles 26, as well as a removable crank handle 46 that can adjust an axle 48 that is connected to a set of axle spindles 70. The axle 48, when moved, may adjust the loaded center of gravity of the portable storage unit 20 that is part of the present invention. The weather shelter support poles 26 may be anchored in multiple places.

Figure 9:
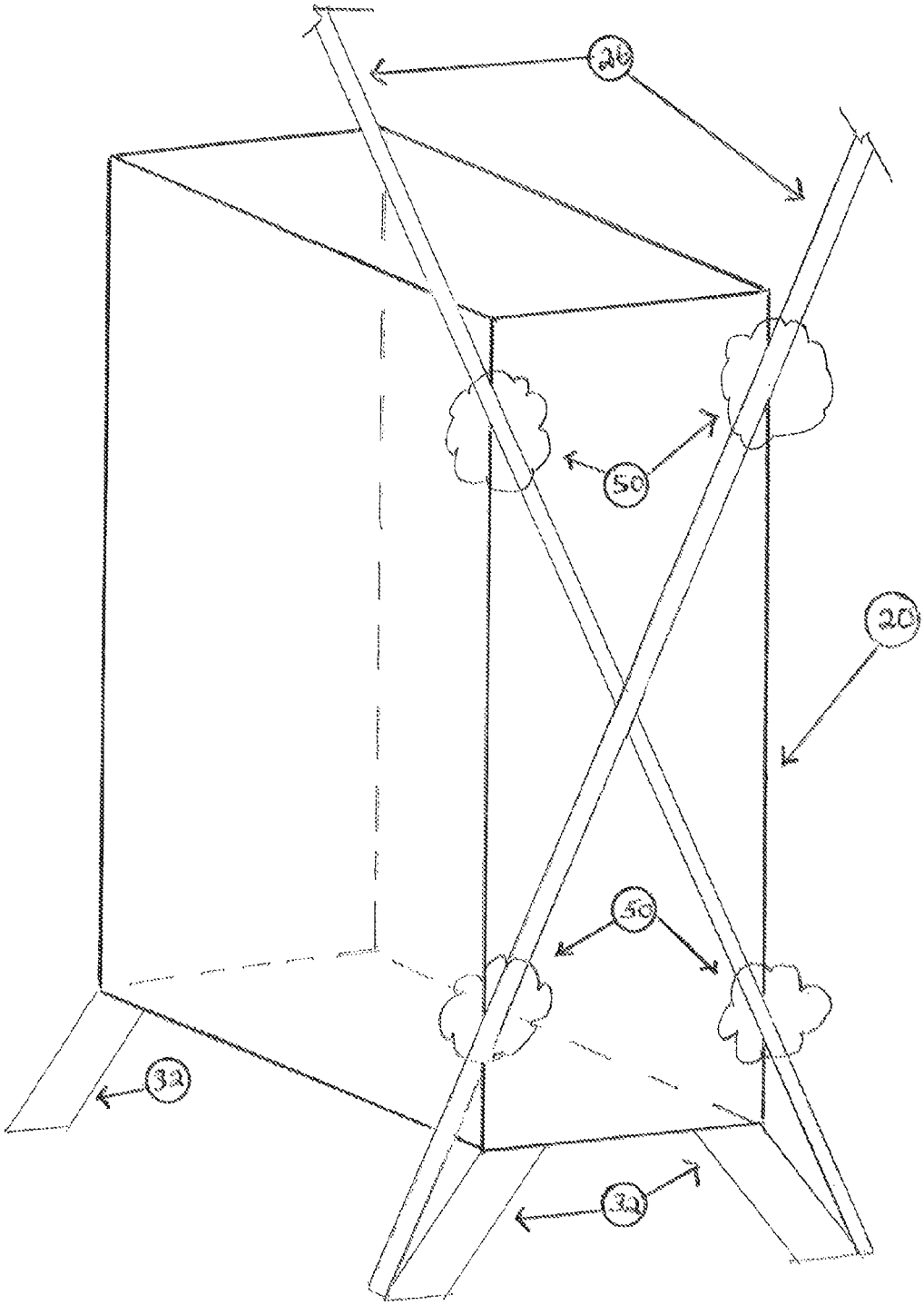
FIG. 9 shows one method of connecting the weather shelter support poles to the portable storage unit that is part of the present invention by means of threaded box-embedded fasteners.

FIG. 9 shows one method of connecting the weather shelter support poles 26 to the portable storage unit 20 that is part of the present invention. As the weather shelter support poles 26 cross each other and pass the edges of the portable storage unit 20, they may be mechanically attached to the portable storage unit 20 by threaded box-embedded fasteners 50. The clouded symbols in FIG. 9 show the locations for one embodiment of these attachments. At ground level, a metal anchor stake may be driven into the ground beside the removable support legs 32 which, when clipped, may lock the removable support legs 32 and weather shelter support poles 26 both to each other and to the ground. The removable support legs 32 may help to keep the portable storage unit 20 stationary.

Figure 10:
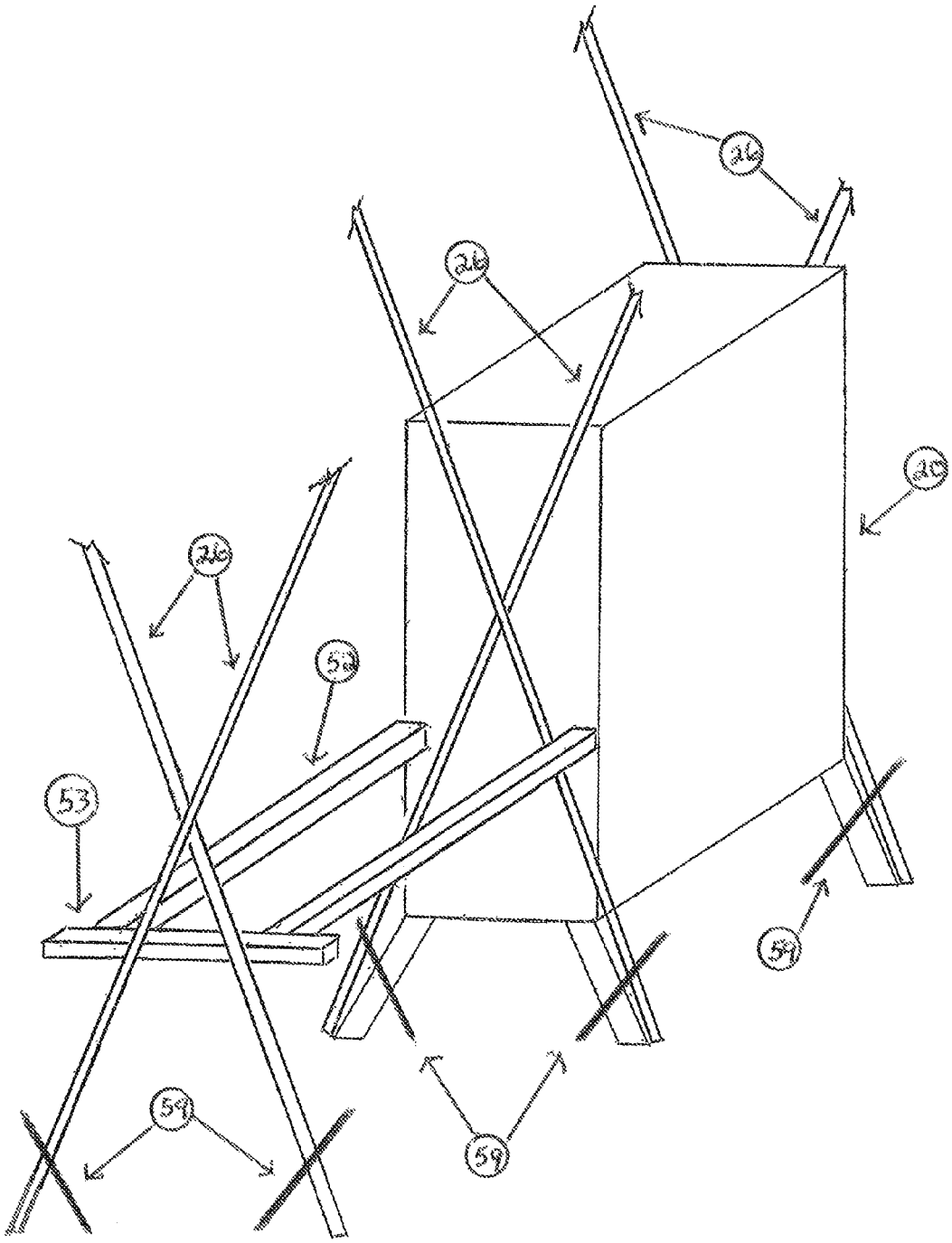
FIG. 10 shows an embodiment of the portable storage unit that is part of the present invention, in which an extra set of weather shelter support poles is installed horizontally at a desired distance from the portable storage unit.

FIG. 10 shows an embodiment of the portable storage unit 20 that is part of the present invention, in which an extra set of weather shelter support poles 26 is installed horizontally at a desired distance from the portable storage unit 20. This facilitates construction of a larger weather shelter. For optimum weather protection, a set of gear rack/weather shelter beams 52 may also be used. The gear rack/weather shelter beams 52 are taken out from underneath the portable storage unit 20 in order to support an expanded weather shelter. Metal anchor stakes 59 may be driven into the ground beside the removable support legs 32 which, when clipped, may lock the removable support legs 32 and weather shelter support poles 26 both to each other and to the ground.

The sides of the hinged handle 30 may be mechanically connected to the "open end" of the gear rack/weather shelter beams 52. The other end of the gear rack/weather shelter beams 52 is the gear rack handle 53. This solid end may be support attached to the weather shelter support poles 26. Because the gear rack/weather shelter beams 52 are typically 1½ to 2 times as long as the portable storage unit 20, the length of the weather shelter may increase by the same amount. Thus, when an expanded weather shelter is desired, the outside set of weather shelter support poles 26 may be properly supported at a desired distance from the body of the portable storage unit 20. Because the hinged handle 30 is designed to be set at the height of the work surface, the top of the gear rack/weather shelter beams 52 may also provide additional table space as desired.

Figure 11:
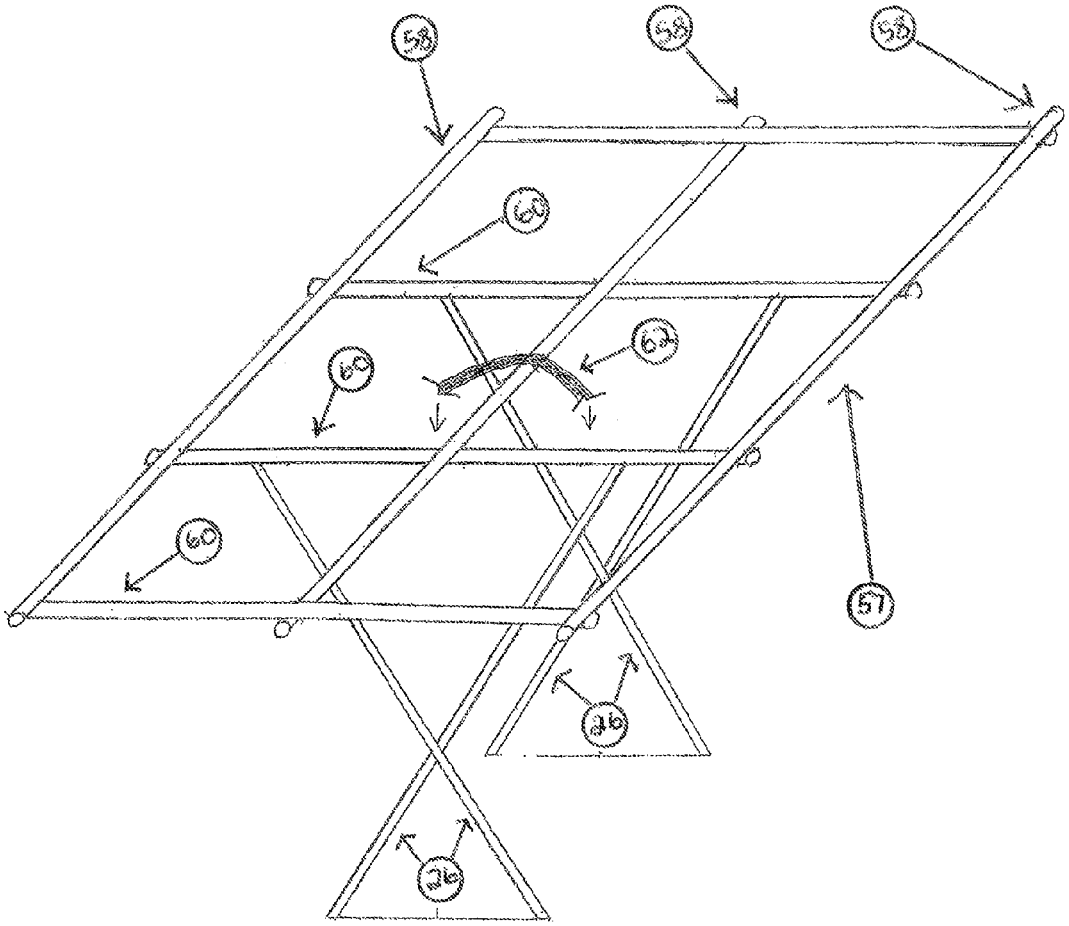
FIG. 11 shows one embodiment of a weather shelter frame, supported by four weather shelter support poles.

FIG. 11 shows one embodiment of a weather shelter frame 57, supported by four weather shelter support poles 26. The cover of the weather shelter frame 57 may be made of a water-resistant material, such as plastic or tarpaulin. Structural integrity of the weather shelter frame 57 may be achieved by applying pull-down force over fulcrum points to create a remote uplift force that is applied to a composite layering system of semi-rigid perpendicular poles. All perpendicular poles may be connected with wingnut sliding swivel connectors to allow easy adjustment for current weather conditions.

Each pair of weather shelter support poles 26 may be attached at two points to a weather shelter support beam 60. In some embodiments, placing weather shelter support beams 58 perpendicularly at either end and in the center of the weather shelter support beam 60 and then applying a pull-down force with a ratchet strap attached to the top of the portable storage unit 20 at a force application point 62 may create a sequential system of pressures and fulcrums that may allow the weather shelter support poles 26 to create the base that supports the weather shelter frame 57. The area covered by the weather shelter frame 57 and its cover is a function of the two different types of pole (length and cross-spans). Ease of transport and construction of the weather shelter frame 57 must be balanced against the size of the area that must be protected from weather.

By loosening wingnuts, changing the perpendicular connector points that set the "X" crossing height of each pair of the weather shelter support poles 26, and changing the length of the weather shelter support poles 26, the weather shelter frame 57 may be adjusted as desired to provide weather protection as conditions change during an outing. The weather shelter frame 57 may also include side panels (not shown in FIG. 11) to further prevent the portable storage unit 20 from sun, wind and rain. Each pair of weather shelter support poles 26 may be independently set to any height to create a customizable weather shelter that "surfs" prevailing winds and helps to create an aerodynamic force pointed downward to enhance stability. Thus, a large area tangent to the portable storage unit 20 may be kept protected from sun, precipitation and wind.

Figure 12:
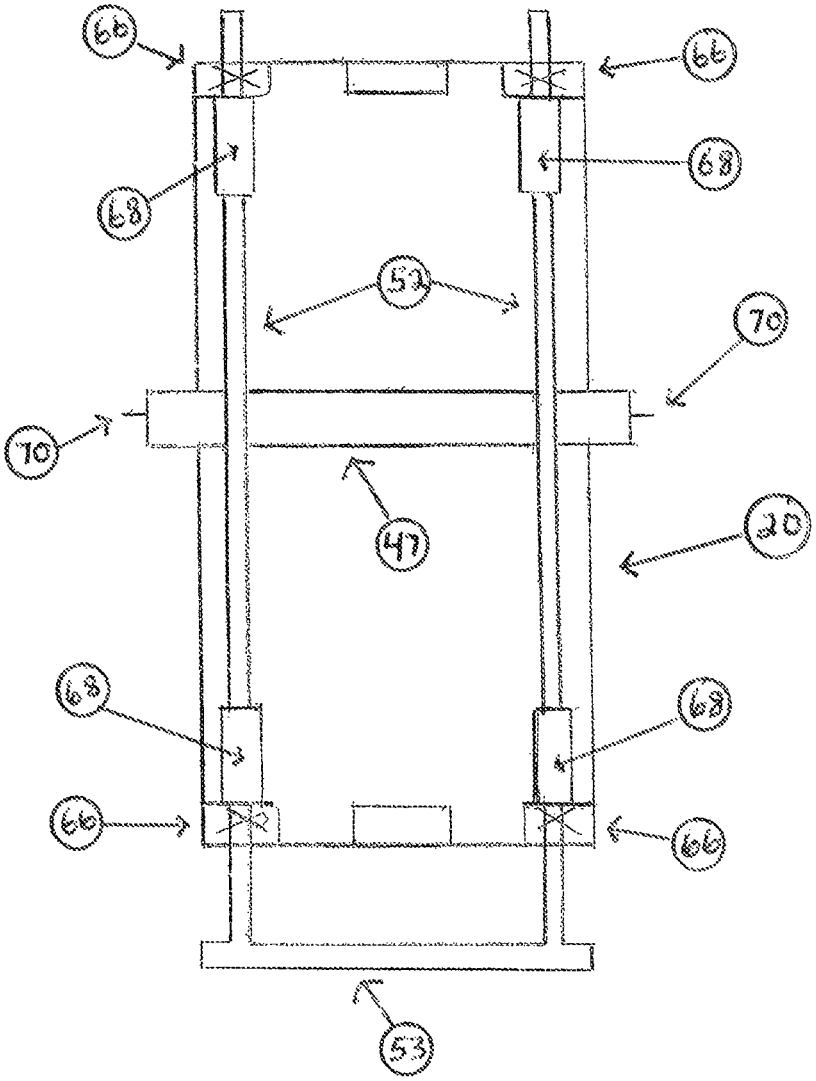
FIG. 12 is a bottom view of one embodiment of the portable storage unit that is part of the present invention that allows the transit center of gravity of the portable storage unit to be changed.

FIG. 12 is a bottom view of one embodiment of the portable storage unit 20 that is part of the present invention and allows the transit center of gravity of the portable storage unit 20 to be changed. In this embodiment, the set of insert hole locations 66 shown in FIG. 12 are only used to support the portable storage unit 20 when stationary; when the portable storage unit 20 is in motion, the legs may be carried in the storage area under the top storage lid 24 shown in FIG. 1.

The "male" size of the gear rack/weather shelter beams 52 may be slightly smaller than the inner dimension of the "female" gear rack guide tubes 68 attached to the bottom of the portable storage unit 20. The gear rack/weather shelter beams 52 are permanently joined on one end by a gear rack handle 53 to create a U-shaped unibody component. Once the gear rack/weather shelter beams 52 are connected to the gear rack guide tubes 68, the gear rack/weather shelter beams 52 may freely slide in and out of the gear rack guide tubes 68 and be easily set to an optimal balance point relative to the center of gravity of the current load being moved. Once the position of the gear rack/weather shelter beam 52 is thus optimized over a fixed position axle 47 and a set of wheels, the gear rack beam may then be cotter-pinned or otherwise fastened through the gear rack guide tubes 68 in preparation for transport.

Multiple holes for cotter pin insertion may be drilled horizontally into and along the length of the gear rack/weather shelter beams 52. If the load feels heavy at the gear rack handle 53, the load can be adjusted by pulling out the cotter pins, sliding the weather shelter beams 52 farther into or out of the gear rack guide tubes 68, and replacing the cotter pins. This adjustment may balance the weight of the load evenly over the tires and reduce the force needed to move the load, similar to a wheelbarrow. The gear rack handle 53 that ties the two gear rack beams 52 together may serve as a push handle to allow better steering when the portable storage unit 20 is moving. Combined with wheels, the additional length of the weather shelter beams 52 allows for more gear to be transported than the portable storage unit 20 can hold by itself. Much like lifting a wheelbarrow, with wheels present, by adjusting the lifting position of a longer length of shelter beam 52, the load's center of gravity can be adjusted to make the portable storage unit 20 easier to lift, move and maneuver.

In optimum embodiments, the axle may present two axle spindles 70 that may have a pair of wheels attached. In some embodiments, the wheels may be ruggedized or "high-performance" to move the portable storage unit 20 more easily over hilly, unpaved or other difficult terrain. The larger the diameter of the wheels, the less resistive force is created that impedes movement of the portable storage unit 20. Additional embodiments may include two or more battery-powered electric motors, individually geared at each wheel, that, in combination, allow wireless control of the movements of the portable storage unit 20 in all directions.

Figure 13:
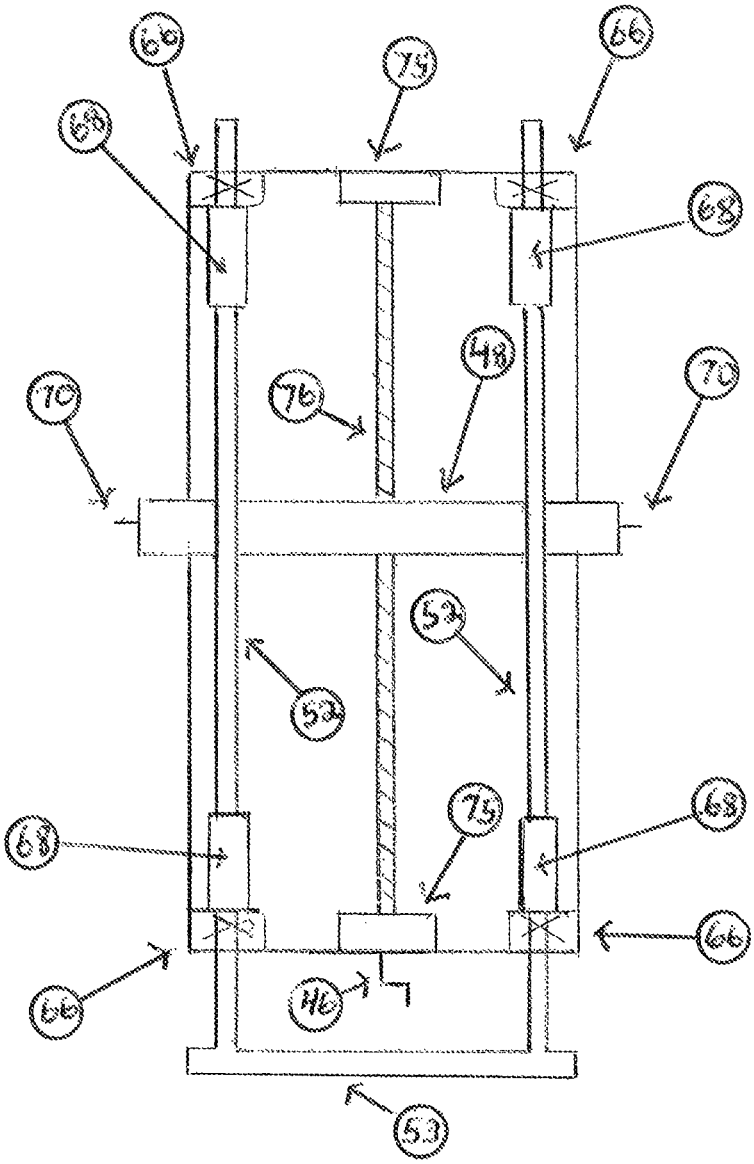
FIG. 13 is a bottom view of another embodiment of the portable storage unit that is part of the present invention and allows the transit center of gravity of the portable storage unit to be changed by a method different from that of FIG. 12.

FIG. 13 is a bottom view of another embodiment of the portable storage unit 20 that is part of the present invention and that allows the transit center of gravity of the portable storage unit 20 to be changed by a method different from that of FIG. 12. The axle 48, axle spindles 70, wheels, insert hole locations 66, gear rack/weather shelter beams 52 and gear rack guide tubes 68 may be the same as in FIG. 12. However, in this embodiment, adjusting the gear rack/weather shelter beams 52 plays no role in adjusting a load's center of gravity. Instead, the axle itself may be designed to move along the length of the portable storage unit 20. The axle movement is achieved by turning the removable crank handle 46, which may be connected to an adjustable axle screw jack 76 that may be held in place by a screw jack spin block 75 at each end. In this embodiment, the axle 48 and wheels may be connected to the adjustable axle screw jack 76.

As the removable crank handle 46 is cranked by a user, the axle 48 and wheels are moved back and forth along the adjustable axle screw jack 76. As the axle 48, axle spindles 70 and wheels have their positions changed along the adjustable axle screw jack 76, the entire center of gravity of the portable storage unit 20 may shift in accordance with the position of the axle 48 and wheels and with the weight of the gear being carried. When the removable crank handle 46 is adjusted properly and the load has been balanced and shifted over the axle 48 and wheels, the effort needed to lift the entire portable storage unit 20 is minimized. The portable storage unit 20, even if fully loaded with gear, may thus be moved to a new location, similar to a wheelbarrow. The gear rack handle 53 that ties the two gear rack/weather shelter beams 52 together may act as a handle as desired. In some embodiments, the wheels may be ruggedized or "high-performance" so that the portable storage unit 20 may be moved more easily over hilly, unpaved or other difficult terrain. In optimum embodiments, the removable crank handle 46 may be removed from the portable storage unit 20 when not in use and reattached as needed.

Figure 14:
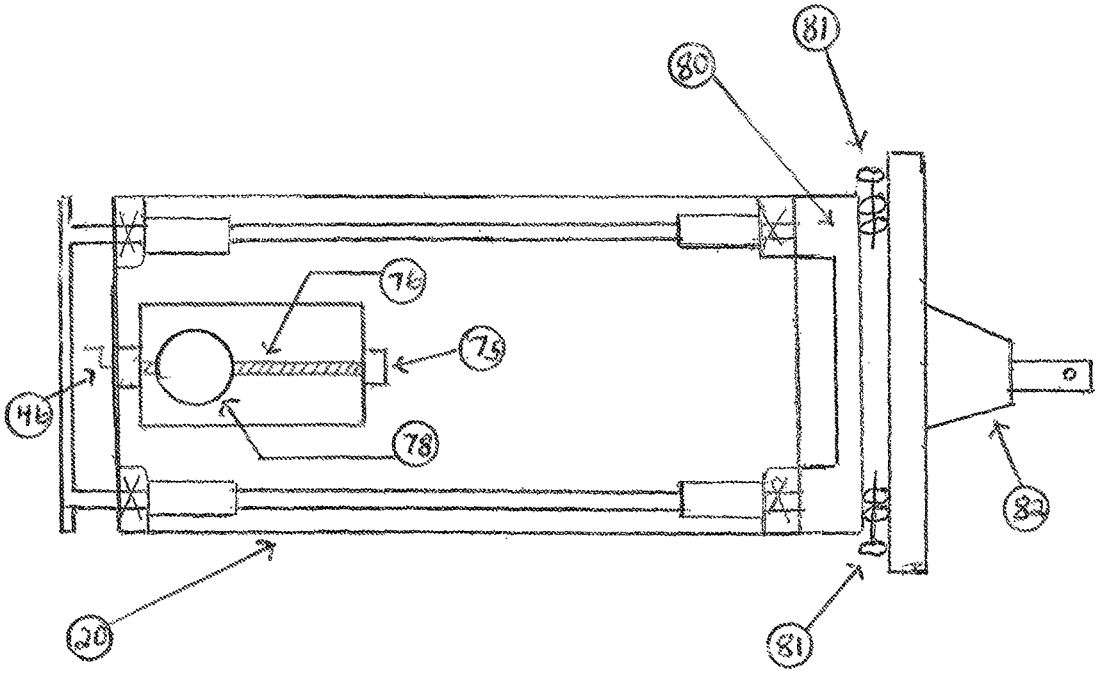
FIG. 14 is a bottom view of an embodiment of the portable storage unit that is part of the present invention that allows the portable storage unit to be towed by a vehicle. The figure also reflects a third method of changing the center of gravity of the portable storage unit that is different from FIGS. 12 and 13.

FIG. 14 is a bottom view of an embodiment of the portable storage unit 20 that is part of the present invention and allows the portable storage unit 20 to be towed along a rigid longitudinal axis by a vehicle, even if the vehicle is smaller than a truck or SUV and even if the driver has no experience in pulling an object behind his car. In this embodiment, a swivel wheel assembly 78 is attached to the underside of the portable storage unit 20. A box pivot assembly 80 is attached to the towing end of the box and a hitch pivot assembly 82 is attached to the vehicle.

A pivot knuckle pin 81 set in at least two places between the box pivot assembly 80 and hitch pivot assembly 82 allows for creation of a vertical hinge point between the tow vehicle and the load it is pulling. Because there are at least two pivot knuckle pins 81, a towed load never leaves its perpendicular orientation with respect to the towing vehicle. In any combination, straight or turning, forward or backward, the tow design remains rigid and never changes its perpendicular orientation. This is a great benefit to drivers who lack experience in towing.

The embodiment of FIG. 14 may also have its loaded center of gravity adjusted with a smaller version of the axle screw jack assembly described in FIG. 13 that uses the removable crank handle 46, the adjustable axle screw jack 76 and the screw jack spin blocks 75. This is necessary because without ability to adjust the loaded center of gravity, certain loaded configurations may impose an excessive downward force on the rear of the towing vehicle. This effectively removes weight from the towing vehicle's steering axle and may cause dangerous instability.

Figure 15:
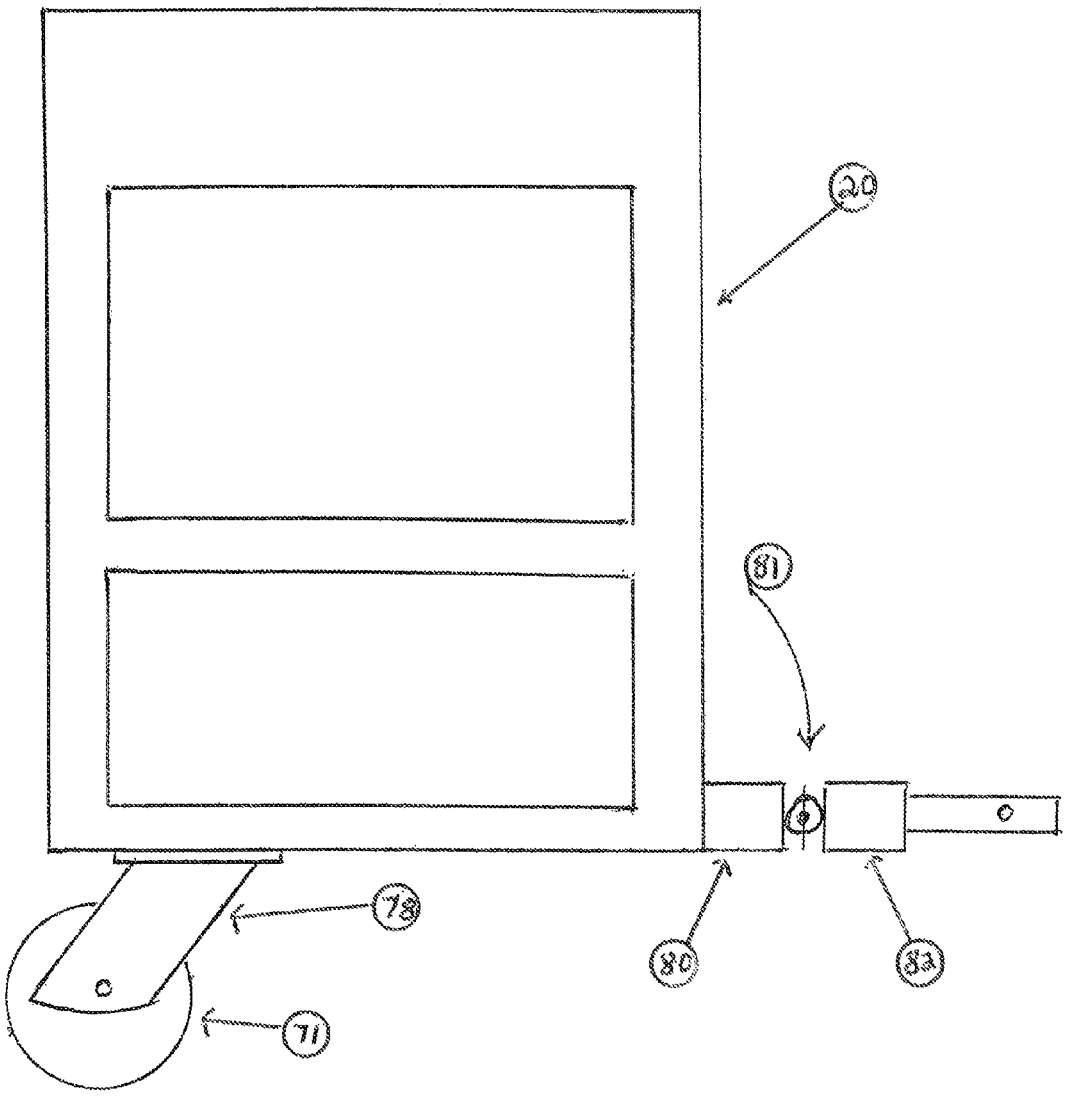
FIG. 15 shows a side view of the embodiment of FIG. 14.

FIG. 15 shows a side view of the embodiment of FIG. 14 that shows the pivot knuckle pin 81 and hitch pivot assembly 82. The box pivot assembly 80 is designed to remain unmoving; only the swivel wheel assembly 78 may move as the towing vehicle moves. Thus, the portable storage unit 20 is always parallel to the towing vehicle. No matter what direction the towing vehicle may move, the box pivot assembly 80 keeps the portable storage unit 20 from jack-knifing or falling over and allows the portable storage unit 20 to be moved to any location safely by a towing vehicle. When the embodiment in FIG. 15 is used in conjunction with a light-duty receiver hitch on the back of a car, even a small car may tow the portable storage unit 20 on public roads, including interstate highways, without unpacking any materials loaded on the portable storage unit 20.

Figure 16:
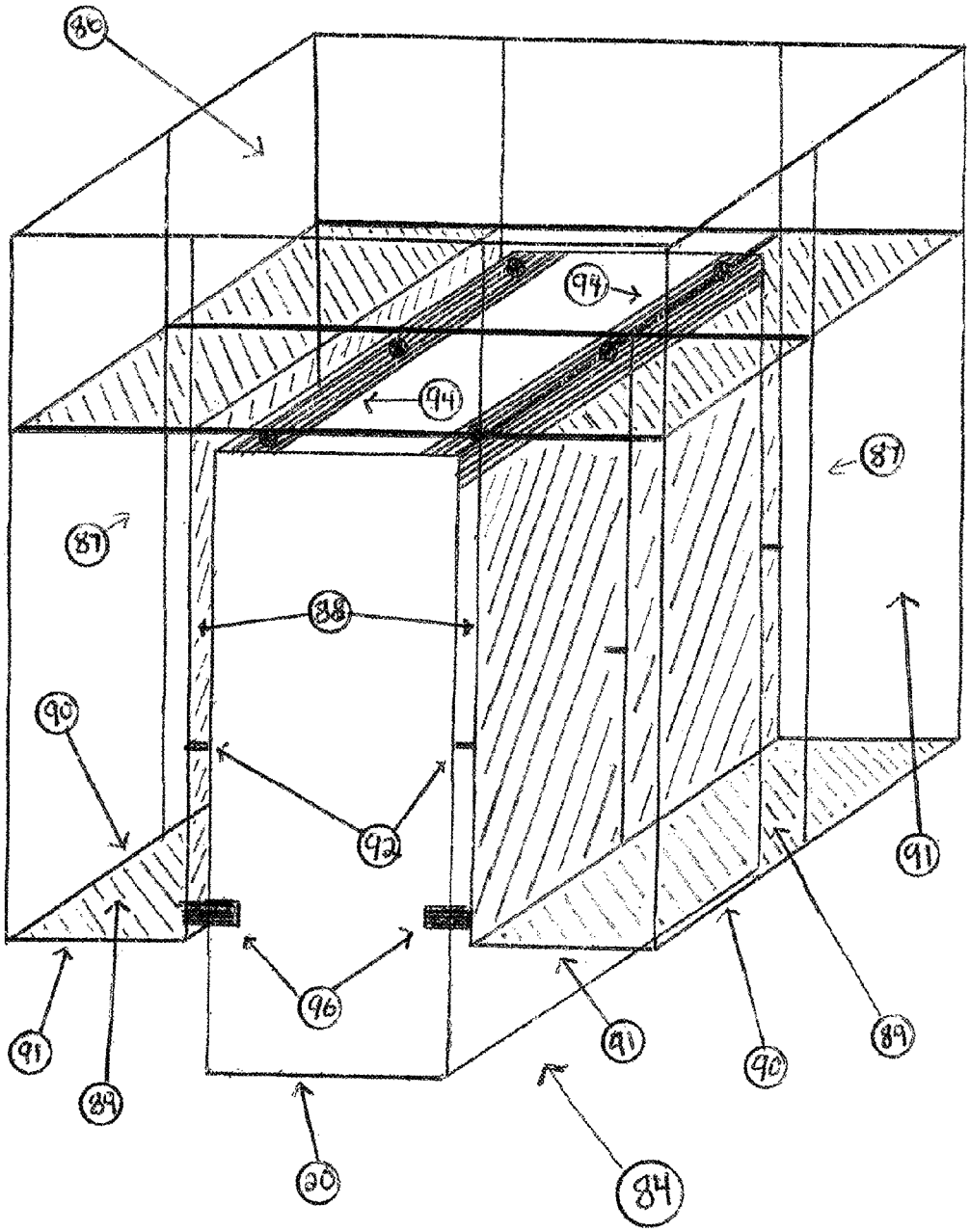
FIG. 16 shows one embodiment of an optional gear rack that may be combined with the portable storage unit that is part of the present invention.

FIG. 16 shows one embodiment of an optional gear rack 84 that may be combined with the portable storage unit 20 that is part of the present invention. The gear rack 84 may look similar to a carport, with an empty inverted U-shaped area inside that is formed by two sides and a top piece. This open area may be sized to fit snugly over the top dimensions of the portable storage unit 20.

The gear rack 84 may contain three physically separated storage areas. The first of the three is the top gear bay 86, which is a four-sided storage area with an open top. The sides and bottom of the top gear bay 86 may be covered with metal mesh or other lightweight flexible material and secured with rope or other fasteners so that gear does not slip or fall out in transit.

The other two of the three storage areas of the gear rack 84 are the side gear bays 87, located along each side and under the top of the portable storage unit 20 and underneath the bottom of and outside ends of the top gear bay 86. The side gear bays 87 are illustrated in FIG. 16 by cross-hatching some of the intersecting planes. For each side gear bay 87, the inside wall 88 is nearest the portable storage unit 20. The inside wall 88, floor 89, and side 91 of each gear bay may all be covered in wire mesh or other lightweight flexible material. In this embodiment, the open side 90 of each side gear bay 87 may be left open to facilitate gear loading and access. Gear in each side gear bay 87 may be secured and kept within each external open side by rope, netting, or other suitable fasteners. Some embodiments may include doors to cover the open side 90 of each gear bay, as well as the top of the top gear bay 86.

A set of side rollers 92 may be secured to the gear rack 84, and a set of top rollers 94 may be secured to the portable storage unit 20 to allow the gear rack 84 to roll up to, onto, or down its transit position on top of the portable storage unit 20. Metal straps may be attached to the bottom side of the top gear bay 86 to facilitate rolling of the side rollers 92 and top rollers 94. Once the gear rack 84 is positioned for transit, the gear rack 84 may be secured to the portable storage unit 20 by a set of fasteners, such as the hinged travel fasteners 96.

Figure 17:
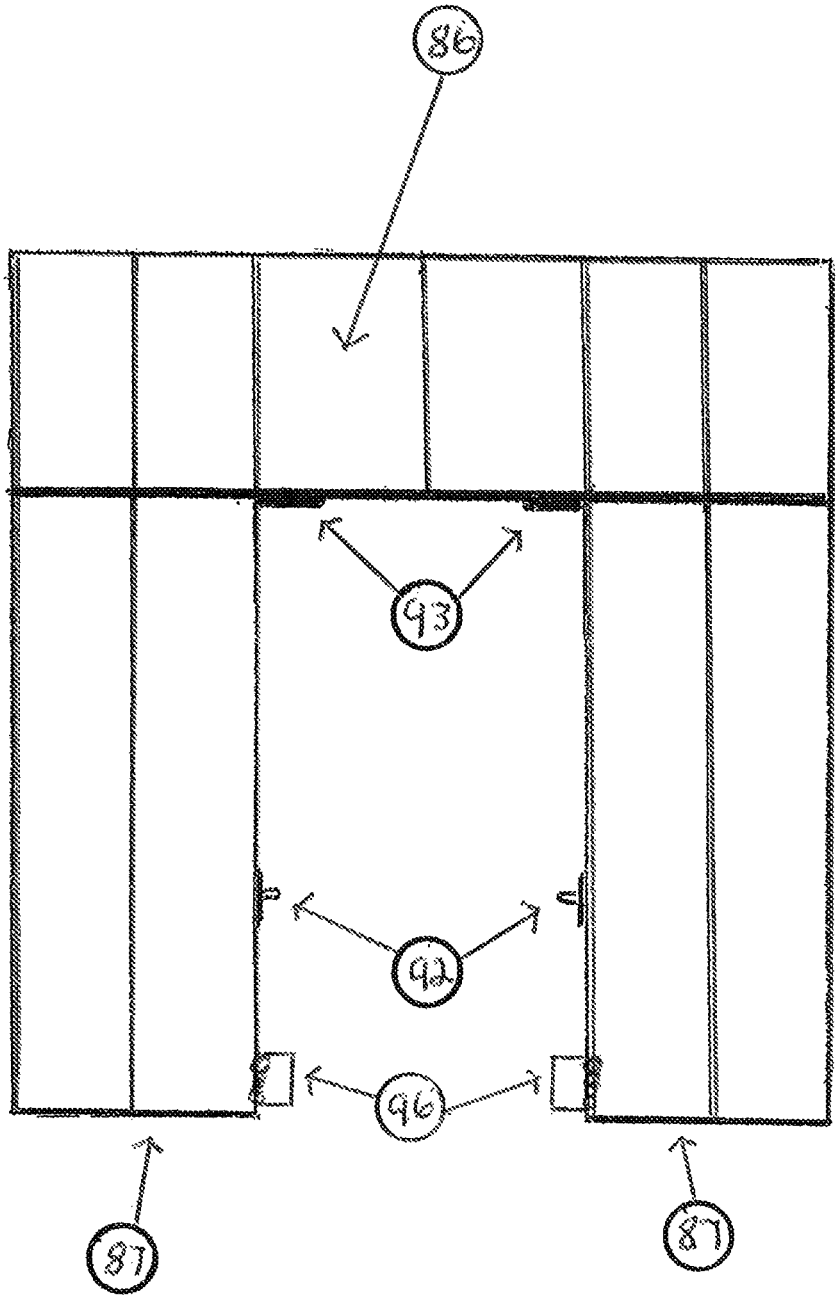
FIG. 17 shows an end elevation view of one embodiment of the gear rack that shows the ends of the inside wall gear bays, a side of the top gear bay and a front/back side of the gear bay 91.

FIG. 17 shows an end elevation view of one embodiment of the gear rack 84.

The side rollers 92 may be secured to the gear rack 84 to allow the gear rack 84 to slide onto the portable storage unit 20, as shown in FIG. 16. The horizontal darker and thicker lines in FIG. 17 in the corner under the bottom of the top gear bay 86 and the inside walls of the side gear bays 87 allow an end view of the two roller straps 93 that may serve as a travel surface. This combined roller interface design allows the gear rack 84 to easily and effectively be slid onto the portable storage unit 20.

The ability to move all embodiments of the present invention through difficult terrain saves work and adds enjoyment for campers, who can thus push one object and take all of their needed gear to a remote location in a single trip instead of carrying gear by hand and by many separate trips.

The present invention therefore provides a portable storage and transport unit with multiple storage areas (at least one of which is adjustable in height), support points that accommodate adjustable supports to allow some storage areas to be set at different heights and to be easily moved, a top lidded area that serves as an extra storage location, a weather shelter that protects items within the storage unit from precipitation, a continuous supported work surface area around the entire perimeter of the unit, the ability to adjust the storage unit's center of gravity in multiple ways to make the storage unit easier to move even when heavily loaded, and the ability to be towed by a vehicle without unpacking the storage unit. The present invention also provides a gear rack that may be used to store more gear in combination with the portable storage unit.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A portable storage and transport unit, comprising:

at least one upper storage area, designed at a height to allow efficient storage of less heavy objects, whose hinged door opens downward and lies flat and serves as part of a continuous supported work surface area around the entire perimeter of said portable storage and transport unit;

at least one lower storage area that can accommodate very heavy objects that cannot be safely placed in said upper storage area and whose hinged door opens downward and lies flat;

a top storage area, covered by a lid;

a set of removable support legs that can raise said storage and transport unit off the ground and support said portable storage and transport unit in a stationary position;

a set of gear rack guide tubes that keeps the bottom of said portable storage and transport unit off the ground;

a hinged handle that may be locked in a fully horizontal position and allows said portable storage and transport unit to be lifted and carried;

a mechanism for adjusting the center of gravity of said portable storage and transport unit to allow easier transport of more gear;

a set of side rollers secured to said portable storage and transport unit; and, a set of top rollers secured to said portable storage and transport unit.

2. The portable storage and transport unit of claim 1, wherein said upper storage area contains at least one support point for at least one shelf of adjustable height.

3. The portable storage and transport unit of claim 2, wherein said shelf of adjustable height divides the internal space of said upper storage area into smaller storage spaces.

4. The portable storage and transport unit of claim 1, further comprising two or more battery-powered electric motors, individually geared at each wheel, that allow wireless control of the movements of said portable storage unit in all directions.

5. The portable storage and transport unit of claim 1, further comprising a system that shelters said portable storage and transport unit from weather, comprising:

a weather shelter frame;

a cover for said weather shelter frame, made of a water-resistant material;

a set of weather shelter support poles that connects to and supports said weather shelter frame, is adjustable to a desired height, can be installed at a desired distance from said portable storage and transport unit, and may be secured into the ground to permit said cover for said weather shelter frame to be placed over said weather shelter frame;

a set of wind anchors, installed at ground level for each of said set of weather shelter support poles; and, a set of sliding gear rack weather shelter beams that fits into said set of gear rack guide tubes and is longer horizontally than said portable storage and transport unit.

6. The portable storage and transport unit of claim 5, wherein said weather shelter frame includes at least one side panel.

7. The portable storage and transport unit of claim 1, wherein said continuous supported work surface area around the entire perimeter of said portable storage and transport unit is created by a combination of the hinged door of said upper storage area, at least one piece of removable lateral work surface support material that slides through and is centered in said hinged handle, at least one piece of removable longitudinal work surface support material, and at least one piece of removable foldable U-shaped hinged work surface material that is set structurally upon said hinged handle.

8. The portable storage and transport unit of claim 1, wherein the mechanism for adjusting the center of gravity of said portable storage and transport unit comprises:

said set of gear rack guide tubes;

a set of sliding gear rack weather shelter beams, with holes drilled along the length of said set of sliding gear rack weather shelter beams to accommodate fasteners, that fits into said set of gear rack guide tubes;

a gear rack beams handle that connects to and forms a U-shaped unibody structure with said sliding gear rack weather shelter beams; and, an axle that, when adjusted, adjusts the center of gravity of said portable storage and transport unit by moving said set of sliding gear rack weather shelter beams along the length of said set of gear rack guide tubes and allowing said set of sliding gear rack weather shelter beams to be fastened into said set of gear rack guide tubes at a desired location.

9. The portable storage and transport unit of claim 1, wherein the mechanism for adjusting the center of gravity of said portable storage and transport unit comprises:

an adjustable axle screw jack held in place by screw jack spin blocks at each end;

an axle movable along the length of said adjustable axle screw jack;

a set of ruggedized wheels connected to said axle; and, a removable crank handle that, when cranked, moves said axle and said set of ruggedized wheels along the length of said adjustable axle screw jack.

10. The portable storage and transport unit of claim 1, further comprising a U-shaped gear rack whose storage areas include a top gear bay and two side gear bays and that rolls on or off the top of said portable storage and transport unit by use of said side rollers and said top rollers.

11. The portable storage and transport unit of claim 1, further comprising a mechanism to allow rigid-longitudinal-axis towing of said portable storage and transport unit by a vehicle smaller than a truck or SUV.

12. The portable storage and transport unit of claim 11, wherein said mechanism to allow towing of said portable storage and transport unit by a vehicle smaller than a truck or SUV has an adjustable center of gravity.

13. The portable storage and transport unit of claim 12, wherein said adjustable center of gravity is adjusted by a mechanism comprising:

an adjustable axle screw jack held in place by screw jack spin blocks at each end;

an axle movable along the length of said adjustable axle screw jack;

a set of ruggedized wheels connected to said axle; and, a removable crank handle that, when cranked, moves said axle and said set of ruggedized wheels along the length of said adjustable axle screw jack.

* * * * *